United States Patent [19]

King, deceased et al.

[11] 3,997,747

[45] Dec. 14, 1976

[54] CIRCUIT INTERRUPTER

[75] Inventors: Paul O. King, deceased, late of Turtle Creek, Pa, by Westinghouse Electric Corporation, Pittsburgh, Pa.

[73] Assignee: Westinghouse Electric Corporation, Pittsburgh, Pa.

[22] Filed: Nov. 20, 1972 (Under Rule 47)

[21] Appl. No.: 308,092

[52] U.S. Cl. ..... 200/144 B; 200/257; 200/260; 200/282; 200/290; 200/258

[51] Int. Cl.[2] ..... H01H 33/66

[58] Field of Search ..... 200/144 B, 166 BB, 166 E, 200/170 A, 170 R

[56] References Cited

UNITED STATES PATENTS

| | | | |
|---|---|---|---|
| 1,968,869 | 8/1934 | Austin | 200/170 R |
| 2,975,254 | 3/1961 | Yanagisawa | 200/166 BA |
| 3,283,100 | 11/1966 | Frink | 200/144 B |
| 3,567,892 | 3/1971 | Boersma et al. | 200/166 BA |

*Primary Examiner*—Robert S. Macon
*Attorney, Agent, or Firm*—L. P. Johns

[57] ABSTRACT

A circuit interrupter characterized by a pair of separable contacts one of which is movable with respect to the other, the movable contact being mounted on an elongated conductor and extending through a tubular conductor with an annular space therebetween, an electrically conducting sleeve within the space and being composed of a resilient sheet-metal type material and having a corrugated configuration. The sleeve being disposed in the annular space in a compressed condition such that the outer ridges are in electrical contact with the tubular conductor and the inner ridges are in contact with the elongated conductor, and a body of resilient material between the tubular conductor and each pair of outer ridges of the conducting sleeve.

14 Claims, 6 Drawing Figures

CIRCUIT INTERRUPTER

CROSS REFERENCE TO RELATED APPLICATION

This invention is related to an invention disclosed in the application of Charles M. Cleaveland, Ser. No. 308,091, filed Nov. 20, 1972.

BACKGROUND OF THE INVENTION

1. Field of the Invention

This invention relates to a circuit interrupter having an improved conducting structure between electrical conductors thereof.

2. Description of the Prior Art

In some types of circuit interrupters, electric current passes through relatively movable surfaces where mechanical external loads are applied and thereby exert contact pressure between those surfaces. For example, in U.S. Pat. No. 3,201,535, a hinge-type conducting structure having particular utility in electrical control apparatus such as disconnecting switches is disclosed, wherein the movable surfaces rotate relative to each other. Current is carried from one surface to the other by means of a resilient corrugated sheet-metal conducting sleeve that is disposed in an annular space between the surfaces.

Vacuum-type circuit interrupters such as disclosed in U.S. Pat. No. 3,603,753 likewise incude movable parts between which current must be transmitted. The vacuum-type circuit interrupter differs, however, from the hinge-type conducting structure of said U.S. Pat. No. 3,201,535 in that the former includes surfaces that are movable longitudinally rather than rotatively with respect to each other. This is an extension of the known capability of the contact structure as disclosed in said U.S. Pat. No. 3,201,535.

A problem associated with rotating or longitudinally movable surfaces involves the maintenance of surface contact pressures in order to minimize electric resistance to the passage of current. Where the sheet-metal type of conducting sleeve is used between sliding surfaces, additional pressure means must be applied to maintain a good electrical contact between the sleeve and the adjacent parts.

SUMMARY OF THE INVENTION

It has been found in accordance with this invention that the foregoing problem may be overcome by providing a circuit interrupter that includes a pair of electrical conductors that are movable with respect to each other and which are separated from each other by an annular space, a conducting sleeve within the space which sleeve is composed of a resilient sheet-metal type of electrically conducting material and which is preferably a corrugated member having a plurality of outer and inner ridges, the outer ridges being biased against the surface of the outer conductor and the inner ridges being biased against the inner conductor, a body of flexible material disposed in the annular space and between each pair of outer ridges and being in a compressed condition such that the inner ridges are held in pressurized contact with the inner conductor, and the flexible material acting as a supplemental spring within the assembly.

The advantage of the device of this invention is that it provides for the maintenance of good electrical contact betweeen the conducting sleeve and the surrounding surfaces of the associated conductors, whereby the resistance to passage of current between the conductors is maintained at a minimum regardless of manufacturing tolerance and assembly technique, and in such a way as not to increase the size of the assembly. This improvement has made the contact consistently reliable for currents of the order of 40,000 amperes.

DESCRIPTION OF THE PREFERRED EMBODIMENTS

Figure 1:
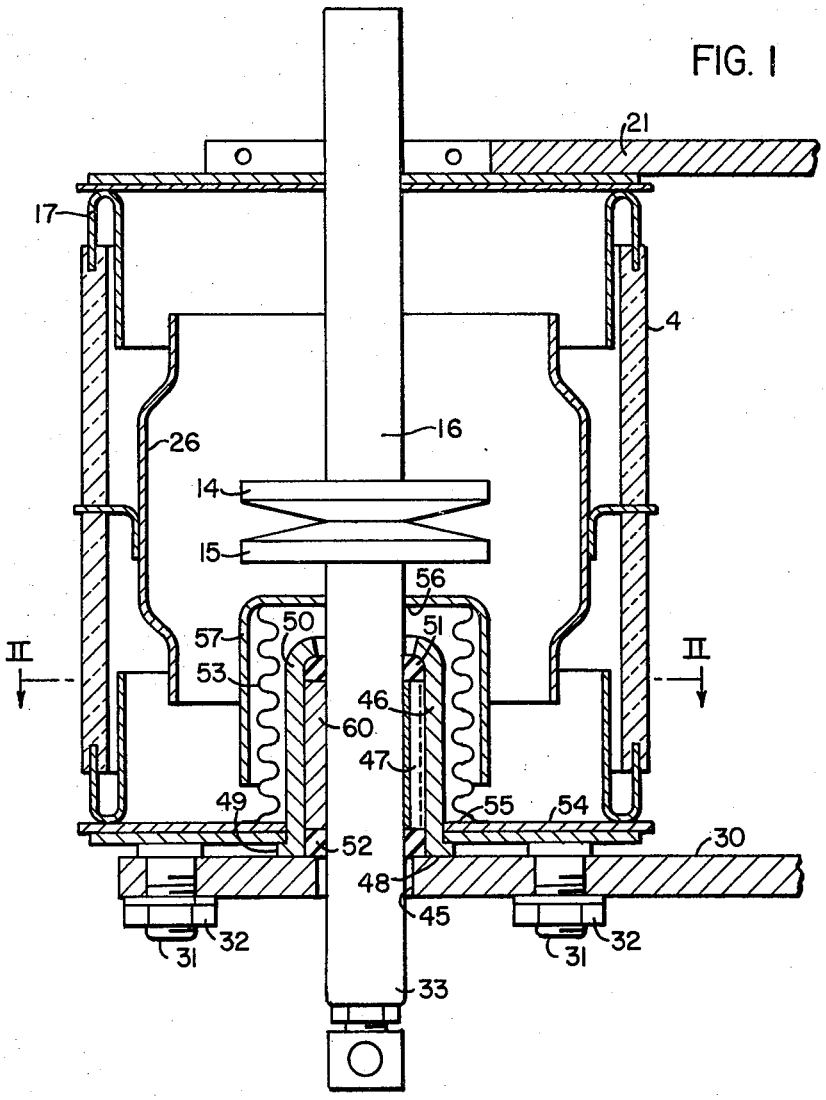
FIG. 1 is a fragmentary vertical sectional view of a vacuum-type circuit interrupter taken on the line I—I of FIG. 2.

FIG. 1 illustrates the internal construction of a vacuum-interrupter element 4 showing the separable contacts 14, 15, upper contact 14 being a stationary contact and supported upon a stationary contact rod 16 extending upwardly through an upper end 17 of the vacuum-interrupter element.

A conducting support member 30 is secured to the vacuum-interrupter element 4 by mounting studs 31 supplied with the interrupter element by the manufacturer, and these mounting studs 31 may extend through registering apertures provided in the flat supporting member 30 and secured thereto by suitable mounting nuts 32.

Figure 3:
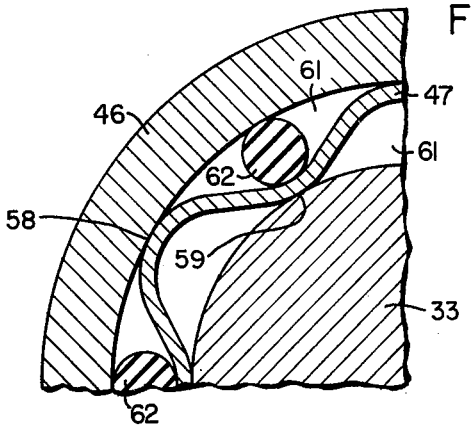
FIG. 3 is an enlarged horizontal sectional view of a sector of the conducting stretcher shown in FIG. 2.

As shown in FIG. 1, a movable contact rod 33 extends through an opening 45 in the support member 30. Means for providing for an electrical connection between the conducting member 30 and the contact rod 33 is provided and comprises a tubular structure around the rod. The tubular structure includes a tubular electrical conductor 46 and means including a conducting sleeve 47 for carrying current between the tubular conductor 46 and the contact rod 33. The tubular conductor 46 is a cylindrical member, one end portion of which is in surface-to-surface abutment at 48 with the conducting member 30 and to increase that surface contact the conductor 46 may be provided with a peripheral flange 49. The upper end portion 50 of the tubular conductor 46 is inturned toward the axis of the conductor in order to provide means for retaining the sleeve 47 in place. As shown in FIG. 3, the inner diameter of the conductor 46 is greater than the diameter of the rod 33 to provide a space in which the electrically conducting sleeve 47 is disposed. At each end of the sleeve 47, insulating guide rings 51 and 52 are provided to maintain the sleeve 47 in place during vertical movement of the rod 33.

To maintain the vacuum condition within the element 4 a bellows 53 is provided between one end plate 54 of the element and the rod 33. Thus, the lower end of the bellows 43 is secured to the plate 54 at 55 and the upper end of the bellows is secured to the control rod at 56. In addition, an inverted cup-shaped shield 57 is provided to maintain the integrity of the bellows from any injurious effect resulting from the contacts 14 and 15 opening and closing.

Current is carried from the tubular conductor 46 to the rod 33 by the electrically conducting sleeve 47, one form of which is a corrugated configuration as shown in FIG. 1 and more particularly in FIG. 3. The conducting sleeve 47 includes a plurality of outer ridges 58 and inner ridges 59, the former of which engage the inner surface of the tubular conductor 46 and the latter of which engage the surface of the rod 33. The outer and inner ridges 58 and 59 are alternately disposed and the sleeve 47 is split to provide two end portions that are biased apart by a wedge member 60 that is driven between the end portions to charge the cleeve so that the ridges are biased against the tubular conductor 46 and the rod 33. The conducting sleeve 47 comprises a member having high electrical conductivity and good mechanical stiffness or spring characteristics. Tests have been conducted successfully with a conducting sleeve comprising zirconium-copper alloy of the type sold under the trade name AMZIRC and having high conductivity (96 percent International Annealed Copper Standard) and high yield strength.

In addition to the sleeve 47 within the annular space 61 between the control rod 47 and the tubular conductor 46, resilient means comprising a flexible member or body, such as a rod 62, is disposed in the annular space. The rod 62 may be disposed between the rod 33 and the sleeve, or between the sleeve and the tubular conductor 46 as shown in FIG. 3, or both. The rod 62 is composed of a resilient or flexible material such as natural rubber, synthetic rubber, elastomeric resin, for example, silicone rubber and fluorocarbon elastomers, such as VITON rubber, for high temperature duty. In the alternative, the rod may be a metallic member such as a coil spring As shown in FIG. 3 the rod 62 serves a primary purpose of maintaining the inner and outer ridges 58 and 59 in contact with the contact rod 33 and the tubular conductor 46.

Laboratory tests were conducted to compare results between an assembly having a corrugated sleeve 47 and a rubber rod 62 (such as shown in FIG. 3) and an assembly with the corrugated sleeve and without the rubber rods. It was found that assemblies with the rubber rods maintained constant contact at the ridges so that the assembly endured ten shots of current at 60,000 amperes asymmetrically for a 10 cycle duration followed by one shot at 36,000 amperes average symmetrical current for 3 seconds, then a 2-second shot at the same current, followed by another 2-second shot. That compares with tests conducted in an assembly including only the corrugated sleeve without the rubber rods whereby contact between the ridges and the slidable contact rod 33 would pass a test of 3 seconds only once, followed by a burn-up or disintegration of the sleeve on a subsequent shot even for shorter times at lower currents.

Moreover, tests revealed that assemblies without the rubber rods resulted in an increase of resistance from 3–5 $\mu\Omega$ up to 20–25 $\mu\Omega$ after one high current test. Assemblies having the rubber rods resulted in an increase in resistance of only from 2 to 4 $\mu\Omega$.

Finally, it was found that by adding the rubber rod 62 to conducting sleeves of the corrugated type, critical tolerances and assembly care was eliminated from the design of the conducting sleeve, thereby providing a more practical assembly procedure.

The diameter of the rubber rods is selected so that a "squeeze" is less than the values allowed in "O"-ring design to assure that the rubber does not yield. In addition, the material of which the rods are composed, such as rubber, must have a temperature endurance far above the operating temperature of the device in order to provide for reliability.

Figure 2:
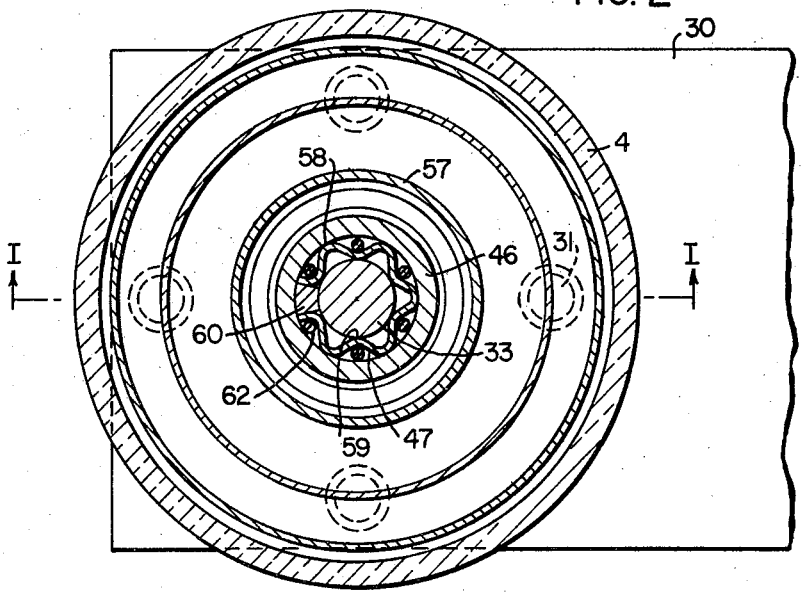
FIG. 2 is a horizontal sectional view taken on the line II—II of FIG. 1.

In addition to the corrugated configuration of the conducting sleeve 47 as shown in FIGS. 2 and 3, the sleeve may be constructed in a variety of forms. For example, another embodiment of the sleeve is shown in FIG. 8 wherein similar numerals refer to similar parts as described above for the assembly of FIG. 3.

Figure 4:
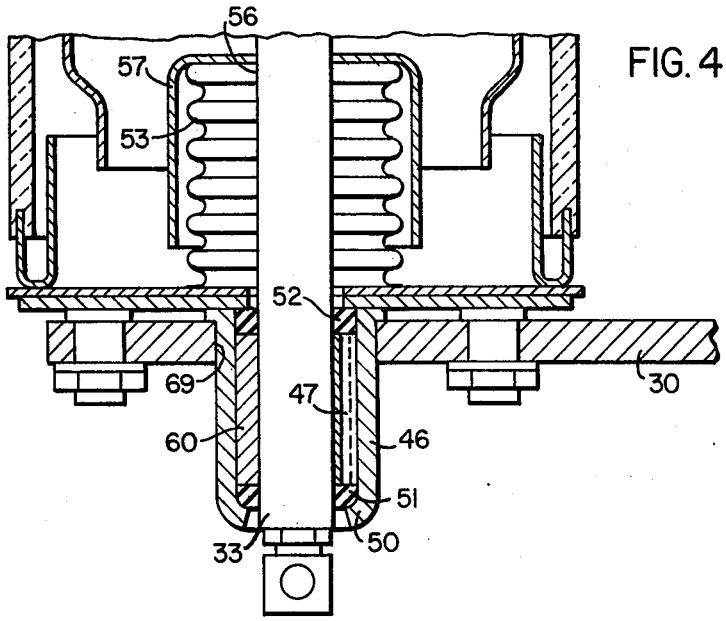
FIG. 4 is a fragmentary vertical sectional view of another embodiment of the invention.

Another embodiment of the invention is shown in FIG. 4 in which the assembly of the thermal conductor 46, the conducting sleeve 47, the end portion 50, guide rings 51 and 52 extend downwardly and outwardly from the circuit interrupter element and around the lower end portion of the rod 33. More particularly said assembly extends through an opening 69 in the conducting member 30 with the flanges 49 being disposed above the member. However, the bellows 53 and the shield are located within the element 4 as in the embodiment of FIG. 1.

Figure 5:
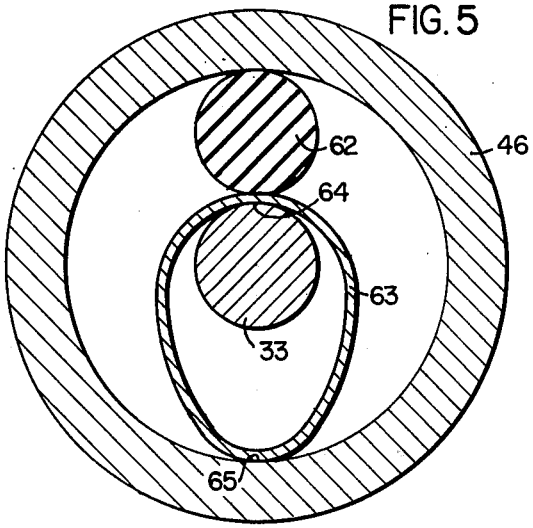
FIG. 5 is a horizontal sectional view of another embodiment of the conducting structure.

In FIG. 5, a conducting sleeve 63 is provided in conjunction with a single rod 62 for maintaining an electrical path between the rod 33 and the tubular conductor 46. The electrically conducting sleeve 63 is preferably a tubular member having a closed cross-section which is circular or oval as shown in FIG. 5. Contact between the rod 33 and the sleeve 63 is maintained at 64 and contact at 65 is maintained between the tubular conductor 46 and the sleeve.

Figure 6:
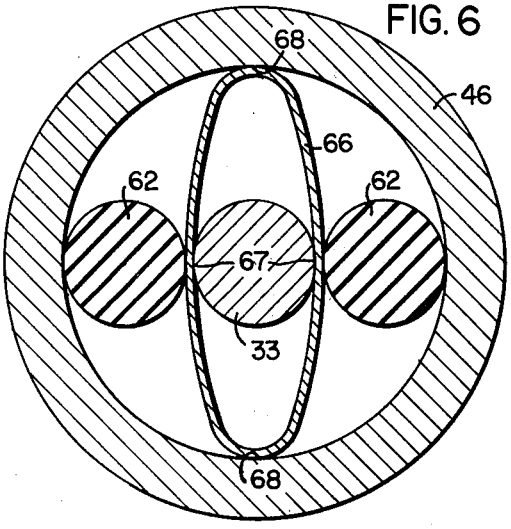
FIG. 6 is a horizontal sectional view of another embodiment of the conducting structure.

Another embodiment of the invention is shown in FIG. 6 in which an electrically conducting sleeve 66 is provided between the rod 33 and the tubular conductor 46. The sleeve 66 is preferably a tubular member having an elliptical-like cross-section, whereby electrical contact points 67 are maintained between the control rod 33 and the sleeve 66 by diammetrically opposed rods 62 and contact points 68 are provided between the tubular conductor 46 and the sleeve 66 in response to pressures provided by the several parts including the members 33, 62, and 46.

What is claimed is:

1. A circuit interrupter comprising a tubular electrical conductor, a second electrical conductor disposed within the tubular conductor, at least one of the conductors being movable relative to the other conductor, an electrically conducting sleeve disposed around said second conductor and within said tubular conductor to carry current from one to the other of said conductors, said electrically conducting sleeve having a portion in electrical contact with said second conductor and having another portion extending radially outwardly in electrical contact with said tubular conductor, and resilient means comprising a body of flexible material between one of said conductors and the sleeve for maintaining the sleeve in a biased position of contact against the tubular conductor and against the second conductor.

2. The circuit interrupter of claim 1 wherein a generally annular space is disposed between the conductors, and the conducting sleeve is located within the annular space.

3. The circuit interrupter of claim 2 wherein the resilient means is disposed between the conducting sleeve and the tubular conductor.

4. The circuit interrupter of claim 2 wherein the second conductor moves relative to the tubular conductor.

5. The circuit interrupter of claim 4 wherein the resilient means is disposed between the conducting sleeve and the tubular conductor, and the conducting sleeve is a sheet-metal type member.

6. The circuit interrupter of claim 2 wherein the conducting sleeve has a good spring characteristics and is disposed in the annular space in a charged condition with a part of the conducting sleeve being biased against the tubular conductor and another part of the conducting sleeve being biased against the second conductor.

7. The circuit interrupter of claim 6 wherein the conducting sleeve is formed with a plurality of ridges on the outside thereof and a plurality of ridges on the inside thereof, and the outside ridges being biased against the tubular conductor and the inside ridges being biased against the second conductor.

8. The circuit interrupter of claim 7 wherein the resilient means comprises a body of flexible material disposed in the annular space and between each pair of outside ridges and being in a charged condition such that the inner ridges are held in pressurized contact with the second conductor.

9. The circuit interrupter of claim 6 wherein the conducting sleeve is a corrugated member.

10. The circuit interrupter of claim 9 wherein the corrugated conducting sleeve comprises alternate inner and outer ridges, the outer ridges contacting the tubular conductor and the inner ridges contacting the second conductor, and the body of flexible material being disposed in the annular space and between each pair of outer ridges and being in a compressed condition such that the inner ridges are held in pressurized contact with the second conductor.

11. The circuit interrupter of claim 10 wherein the body of flexible material is an elastomeric resin.

12. The circuit interrupter of claim 10 wherein the body of flexible material is rubber.

13. The circuit interrupter of claim 10 wherein the second conductor moves longitudinally of the axis of the conducting sleeve.

14. The circuit interrupter of claim 10 wherein the body of flexible material is a metallic coil spring.

* * * * *